US007325272B2

(12) United States Patent
Bosses

(10) Patent No.: US 7,325,272 B2
(45) Date of Patent: Feb. 5, 2008

(54) VACUUM BAG GUIDE WITH TELESCOPIC NOZZLE

(76) Inventor: Mark D. Bosses, 505 NE. Spanish Trail, Boca Raton, FL (US) 33432

( * ) Notice: Subject to any disclaimer, the term of this patent is extended or adjusted under 35 U.S.C. 154(b) by 284 days.

(21) Appl. No.: 11/240,168

(22) Filed: Sep. 30, 2005

(65) Prior Publication Data

US 2007/0074367 A1 Apr. 5, 2007

(51) Int. Cl.
*A47L 5/00* (2006.01)

(52) U.S. Cl. ..... 15/327.2; 15/347; 15/351; 55/373; 55/374; 55/DIG. 2

(58) Field of Classification Search ..... None
See application file for complete search history.

(56) References Cited

U.S. PATENT DOCUMENTS 4,452,618 A * 6/1984 Kuplas ..... 55/362
4,936,883 A * 6/1990 Larsson et al. ..... 55/374
5,028,245 A * 7/1991 Stein et al. ..... 55/373
5,089,038 A 2/1992 Kopco et al.
5,544,385 A 8/1996 Jailor et al.
5,755,009 A 5/1998 Stephens et al.
5,766,283 A * 6/1998 Bumb et al. ..... 55/367
5,970,575 A 10/1999 Lee
6,033,451 A 3/2000 Fish et al.
6,277,165 B1 8/2001 Lovett et al.
6,381,804 B1 5/2002 Paterson et al.
6,442,793 B1 9/2002 Paterson et al.
6,451,078 B2 9/2002 Berfield et al.
6,502,274 B1 1/2003 Harrelson, II
6,560,816 B1 5/2003 Harrelson, II
6,733,555 B1 5/2004 Wilder
2001/0005983 A1 7/2001 Berfield et al.
2003/0200620 A1 * 10/2003 Dodson et al. ..... 15/351
2004/0045119 A1 3/2004 Ponjican et al.

* cited by examiner

*Primary Examiner*—David Redding
(74) *Attorney, Agent, or Firm*—Amster, Rothstein & Ebenstein LLP

(57) ABSTRACT

A vacuum bag mounting assembly for housing a vacuum bag within a vacuum cleaner, where the vacuum cleaner includes a vacuum intake nozzle having an outlet end portion through which sucked in dirt is delivered to the vacuum bag housing assembly, including a vacuum bag storage compartment 1, a vacuum bag collar receiver disposed within the vacuum bag storage compartment that engages a collar of the vacuum bag, and a telescopic nozzle end attached to the outlet end portion of the vacuum intake nozzle, the telescopic nozzle end being moveable along the outlet end portion towards and away from the collar of the vacuum bag. The vacuum bag mounting assembly also includes a housing cover that covers the vacuum bag storage compartment, the housing cover including a nozzle engagement member that engages the telescopic nozzle. The nozzle engagement member is moveable between a first position in which the telescopic nozzle end is engaged with the vacuum bag collar and a second position in which the telescopic nozzle end is disengaged with the vacuum bag collar.

17 Claims, 5 Drawing Sheets

SIDE VIEW

SECTION THRU COVER LATCH

SHOWING LATCH AND NOZZLE FORK MOTION

VACUUM BAG GUIDE WITH TELESCOPIC NOZZLE

TECHNICAL FIELD

The present invention relates to vacuum cleaners and, more particularly, to vacuum cleaners having removable vacuum bags.

BACKGROUND

Conventional vacuum cleaners use fabric or paper bags to capture the dirt and dust picked up by the vacuum cleaner. The process of changing the filter bag is frequently rather difficult and complicated. Past attempts at simplifying the vacuum bag replacement process have included the use of a mounting plate that pivots about a hinge. For example, U.S. Pat. No. 5,089,038 discloses the use of a rectangular mounting plate including a channel that receives a collar of a dust bag. The mounting plate includes a pivot pin which is received within a hinge barrel attached to an inner wall of a vacuum cleaner housing. The pivot pin and hinge barrel allow the mounting plate to pivot to an open position in which the collar can be inserted into or removed from the channel and to a closed position in which the collar is disposed in contact with a vacuum hose. A latch means on the mounting plate is used to latch the mounting plate onto the side of the housing opposite the pivot pin.

The mounting assembly disclosed in the '038 Patent, and other similar mounting assemblies using a hinged mounting plate, are disadvantageous in that they require the vacuum cleaner to have a larger and bulkier construction to allow room for the mounting plate to pivot. Also, the pivoting mounting plate constructions typically require that the mounting plate be latched on or snap-fit into a housing assembly after the vacuum bag is replaced, which adds to the overall complexity of the vacuum bag replacement procedure. In this regard, if the mounting plate is not properly latched on or snap-fit into the vacuum bag housing assembly, the mounting plate may pivot into an open position during use of the vacuum cleaner, thereby disconnecting the vacuum bag from the vacuum hose and allowing dust and dirt particles to scatter throughout the housing assembly. This is particularly problematic in that any free dust or dirt may become lodged in the vacuum cleaner motor or be released back onto the carpet. Further, prior vacuum bag replacement procedures using the hinged mounting plate structure have required the user to operate "in the blind", in that the user does not have a full view inside the housing assembly to ensure that the mounting plate is properly placed in position.

Accordingly, there is a need for a vacuum bag mounting assembly that allows for easy replacement of vacuum bags and a more compact and light-weight overall vacuum cleaner design.

SUMMARY OF THE INVENTION

A vacuum bag mounting assembly according to an exemplary embodiment of the present invention for housing a vacuum bag within a vacuum cleaner, where the vacuum cleaner includes a vacuum intake nozzle having an outlet end portion through which sucked in dirt is delivered to the vacuum bag housing assembly, includes a vacuum bag storage compartment, a vacuum bag collar receiver disposed within the vacuum bag storage compartment that engages a collar of the vacuum bag, and a telescopic nozzle end attached to the outlet end portion of the vacuum intake nozzle, the telescopic nozzle end being moveable along the outlet end portion towards and away from the collar of the vacuum bag. The vacuum bag mounting assembly also includes a housing cover that covers the vacuum bag storage compartment, the housing cover including a nozzle engagement member that engages the telescopic nozzle. The nozzle engagement member is moveable between a first position in which the telescopic nozzle end is engaged with the vacuum bag collar and a second position in which the telescopic nozzle end is disengaged with the vacuum bag collar.

A vacuum cleaner according to an exemplary embodiment of the present invention includes a base portion, a vacuum nozzle head disposed at a bottom portion of the base portion, a handle for maneuvering the vacuum cleaner, a vacuum bag mounting assembly for housing a vacuum bag, and a vacuum intake nozzle having an outlet end portion through which sucked in dirt is delivered to the vacuum bag mounting assembly. The vacuum bag mounting assembly includes a vacuum bag storage compartment, a vacuum bag collar receiver disposed within the vacuum bag storage compartment that engages a collar of the vacuum bag, and a telescopic nozzle end attached to the outlet end portion of the vacuum intake nozzle, the telescopic nozzle end being moveable along the outlet end portion towards and away from the collar of the vacuum bag. The vacuum bag mounting assembly also includes a housing cover that covers the vacuum bag storage compartment, the housing cover including a nozzle engagement member that engages the telescopic nozzle. The nozzle engagement member is moveable between a first position in which the telescopic nozzle end is engaged with the vacuum bag collar and a second position in which the telescopic nozzle end is disengaged with the vacuum bag collar.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
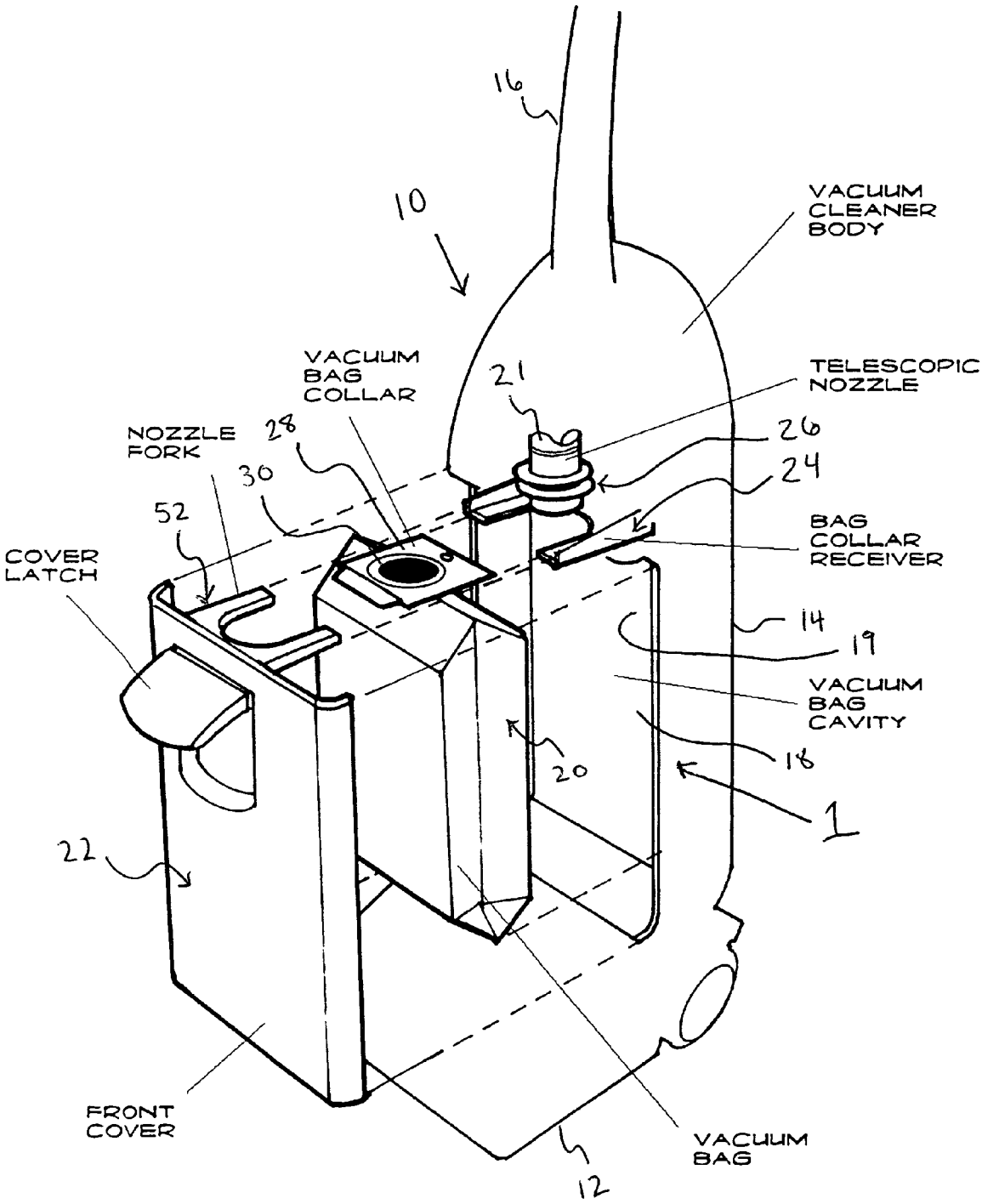
FIG. 1 is an exploded view of a vacuum bag mounting assembly according to an exemplary embodiment of the invention.

FIG. 1 is an exploded view of a vacuum bag mounting assembly 1 according to an exemplary embodiment of the invention constructed as part of a vacuum cleaner 10. The vacuum cleaner 10 includes generally a vacuum nozzle head 12, a vertically extending main body 14 and a handle 16 extending from the upper portion of the main body 14. The mounting assembly 1 includes a vacuum bag storage compartment 18 disposed within the base 14 for storing a removable vacuum bag 20. A vacuum intake nozzle 21, in communication with the vacuum nozzle head 12 opens into the storage compartment 18. The mounting assembly 1 also includes a housing cover 22 that covers the storage compartment 18, a stationary bag collar receiver 24 that extends outwardly from the back wall 19 of the storage compartment 18 and a telescopic nozzle end 26 that is extendable from the vacuum intake nozzle 21. The housing cover 22 may be removeable or hinged to the main body to allow for access to the storage compartment 18. As explained in more detail below, the housing cover 22, the bag collar receiver 24 and the telescopic nozzle end 26 cooperate with one another to hold the vacuum bag 20 in an upright position within the storage compartment 18.

The vacuum bag 20 includes a collar 28 formed at one end, with a collar opening 30 for attachment to the telescopic nozzle end 26. A rubber gasket 32 may be disposed around the circumference of the collar opening 30, so that a tight seal is formed between the telescopic nozzle end 26 and the collar opening 30. As is known in the art, the collar 28 may be made of a flat rectangular or square-shaped cardboard piece.

Figure 2:
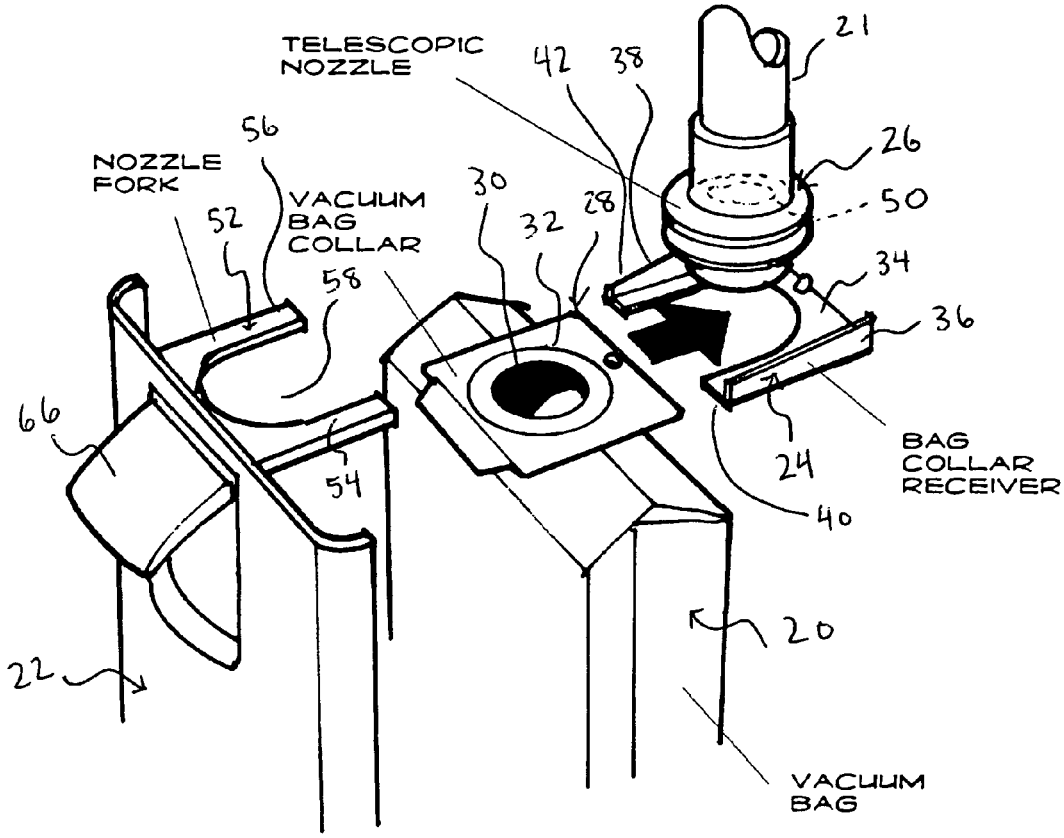
FIG. 2 shows a vacuum bag being placed into the vacuum bag housing assembly of FIG. 1.

As shown in FIG. 2, the bag collar receiver 24 includes a horizontally extending bottom wall 34, a vertically extending first side wall 36 and a vertically extending second side wall 38. A U-shaped opening 35 is formed in the bottom wall 34 so that the bag collar receiver 24 forms a fork shaped structure having a first prong 40, made up of the bottom wall 34 and the first side wall 36, and a second prong 42, made up of the bottom wall 34 and the second side wall 38.

Figure 3:
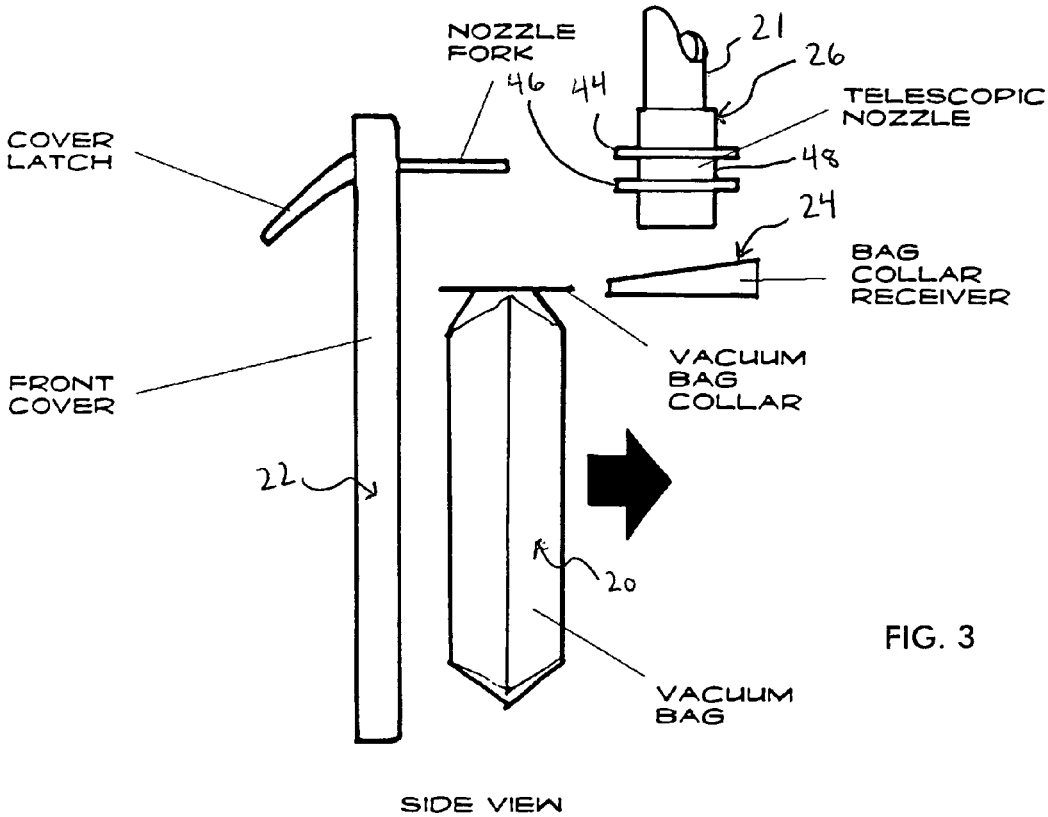
FIG. 3 is a profile view of a vacuum bag being placed into the vacuum bag housing assembly of FIG. 1.

As shown in FIGS. 2 and 3, to place the vacuum bag 20 into the vacuum bag storage compartment 18, the vacuum bag collar 28 is slid into the bag collar receiver 24 such that the first prong 40 and the second prong 42 are disposed underneath the sides of the vacuum bag collar 28. In this position, the collar opening 30 is positioned directly below and in line with the telescopic nozzle end 26 of the vacuum intake nozzle 21.

As shown in FIG. 3, the inner circumference of the telescopic nozzle end 26 is slightly larger than the outer circumference of the vacuum intake nozzle 21, so that the telescopic nozzle end 26 can be placed over and extend from the end of the vacuum intake nozzle 21 with a friction fit. This allows the telescopic nozzle end 26 to be moved vertically up and down along the vacuum intake nozzle 21 so as to effectively lengthen or shorten the vacuum intake nozzle 21. Alternatively, the outer circumference of the telescopic nozzle end 26 may be slightly smaller than the inner circumference of the vacuum intake nozzle 21, so that the telescopic nozzle end 26 can be placed within and extend from the end of the vacuum intake nozzle 21 with a friction fit. The telescopic nozzle end 26 includes an upper flange 44 and a lower flange 46. The upper and lower flanges 44, 46 form a circumferential groove 48 in the telescopic nozzle end 26. In at least one embodiment, the telescopic nozzle end 26 includes an inner flange 50, which contacts the end of the vacuum intake nozzle 21 to prevent the telescopic nozzle end 26 from being pushed over the vacuum intake nozzle 21 beyond a certain point. In an exemplary embodiment of the invention, the telescopic nozzle end 26 may be biased in the up position by a spring or other mechanism.

Figure 10:
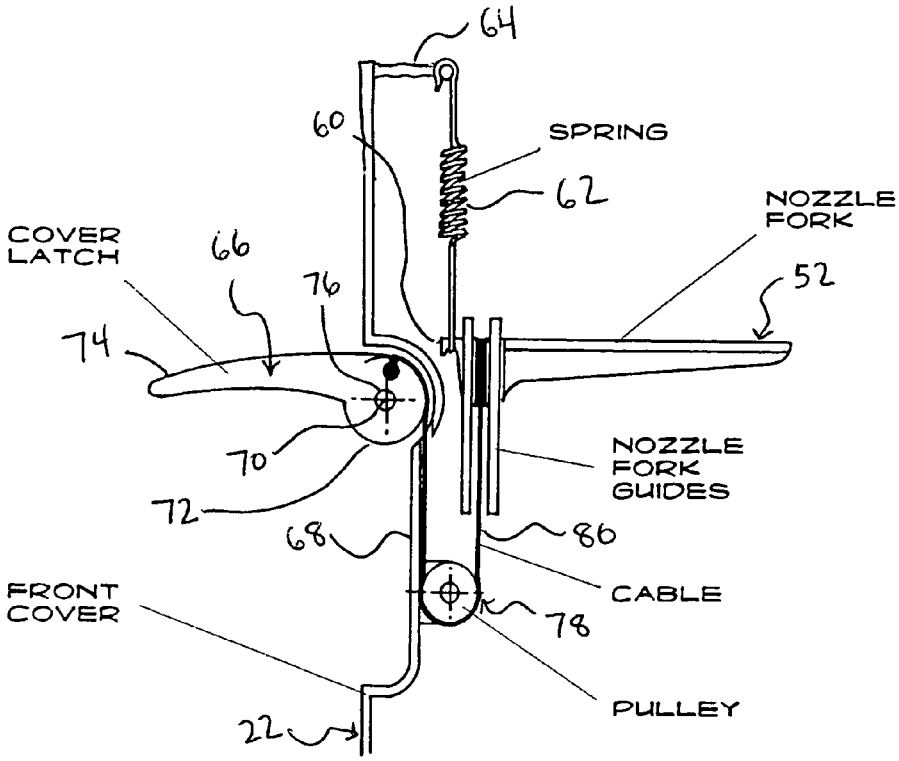
FIGS. 10 and 11 are detailed profile views of a cover latch being pivoted downwards to engage a telescopic nozzle of the vacuum bag housing assembly of FIG. 1.
Figure 11:
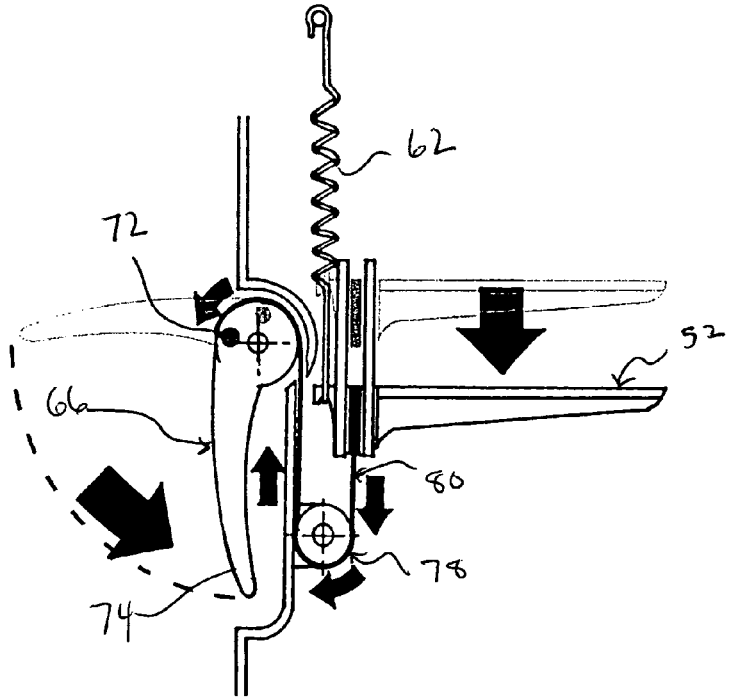

As shown in FIGS. 1-3, a nozzle fork 52 extends horizontally from the upper portion of the inside surface of the housing cover 22. The nozzle fork 52 includes a first nozzle fork prong 54 and a second nozzle fork prong 56. The first and second nozzle fork prongs 54, 56 form a U-shaped opening 58 in the nozzle fork 52. As shown in FIGS. 10 and 11, a spring hook 60 is disposed at the back portion of the nozzle fork 52. One end of a vertically extending spring 62 is attached to the spring hook 60. The other end of the spring 62 is fixed to a spring support 64 that extends horizontally from the inside surface of the housing cover 22 above the nozzle fork 52. The spring 62 biases the nozzle fork 52 upwards. As explained in more detail below, a cover latch 66 disposed on the outer surface of the housing cover 22 may be used to pull the nozzle fork 52 downwards against the upwards bias of the spring 62.

The housing cover 22 includes an indented portion 68 and a pivot rod 70 that extends horizontally across the upper portion of the indented portion 68. The cover latch 66 includes a cam portion 72 and a handle portion 74. A bore 76 extends horizontally through the cam portion 72. The pivot rod 70 extends through the bore 76 of the cam portion 72, so that the cover latch 66 is pivotally attached to the pivot rod 70. As shown in FIG. 11, when the cover latch 66 is pivoted downwards, the indented portion 68 in the housing cover 22 allows for clearance of the handle portion 74. A pulley 78 is disposed on the inner surface of the housing cover 22 below the nozzle fork 52. One end of a cable 80 is fixedly attached to the cam portion 72 of the cover latch 66 and the other end of the cable 80 is fixedly attached to the back portion of the nozzle fork 52. The cable 80 runs from the cam portion 72 to the nozzle fork 52 around the pulley 78. Thus, when the cover latch 66 is pulled downwards, the cable 80 is pulled upwards around the cam portion 72 and downwards around the pulley 78, to thereby provide an overall downward force on the nozzle fork 52 against the biasing force of the spring 62.

Figure 4:
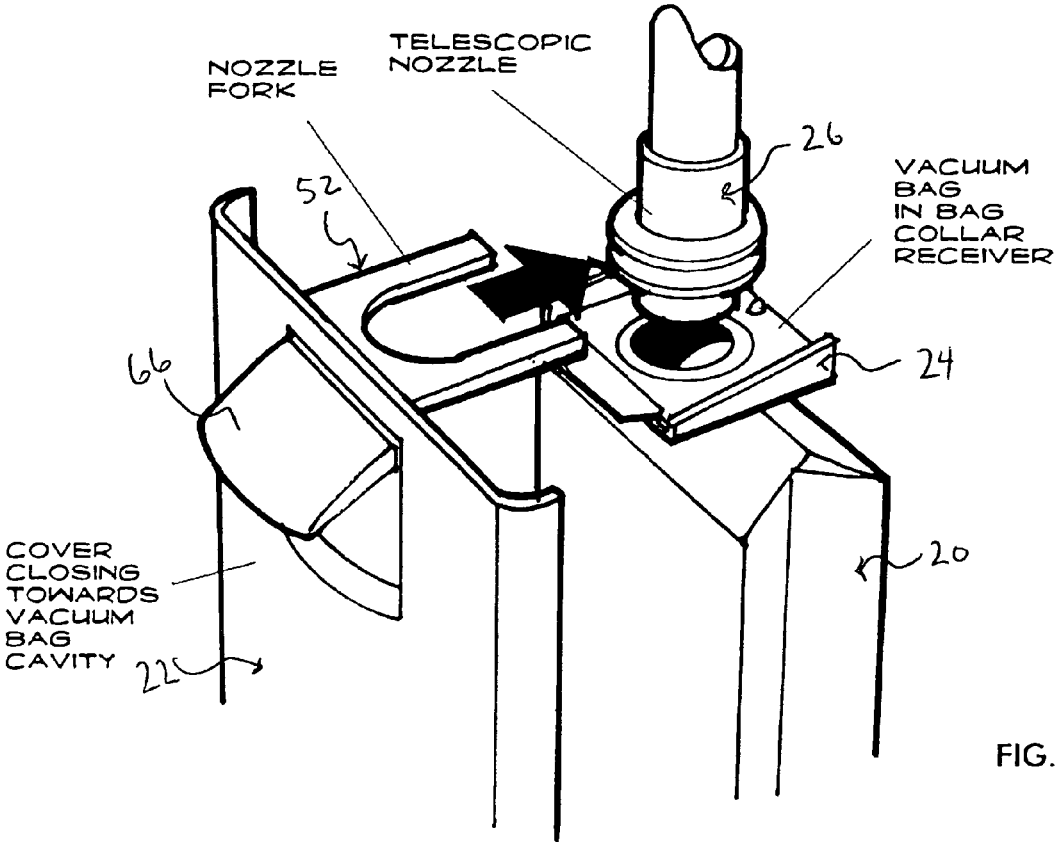
FIG. 4 shows a nozzle fork being engaged with a telescopic nozzle of the vacuum bag housing assembly of FIG. 1.
Figure 5:
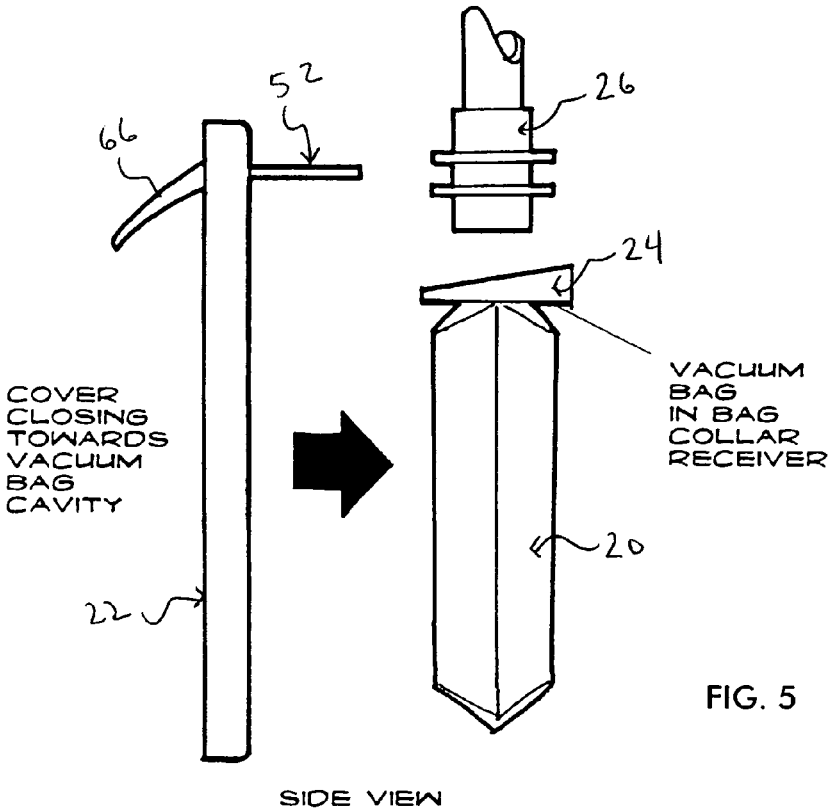
FIG. 5 is a profile view of a nozzle fork being engaged with a telescopic nozzle of the vacuum bag housing assembly of FIG. 1.
Figure 6:
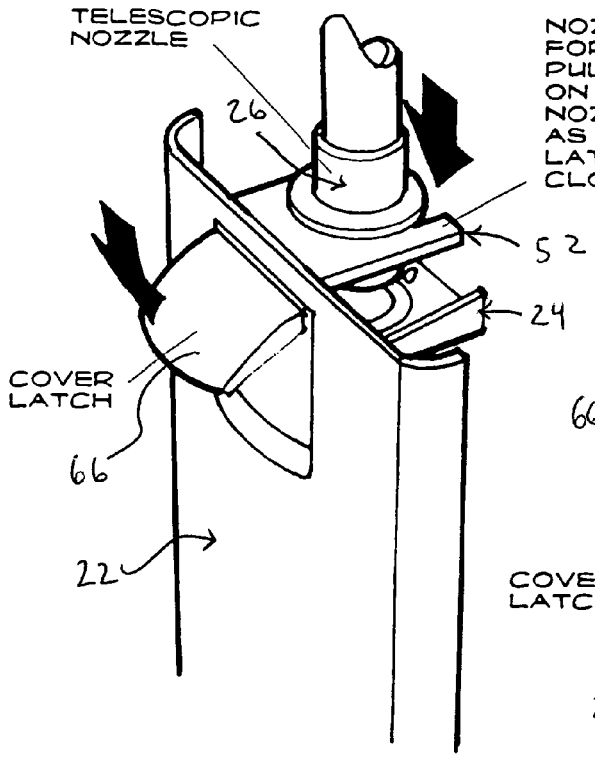
FIGS. 6 and 7 show a cover latch being pivoted downwards to engage a telescopic nozzle of the vacuum bag housing assembly of FIG. 1.
Figure 7:
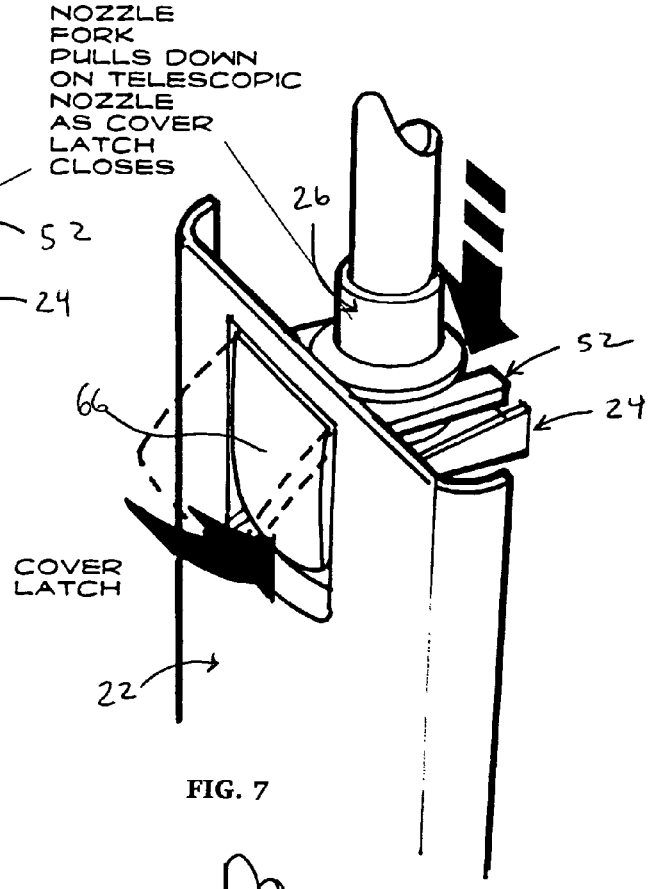
Figure 8:
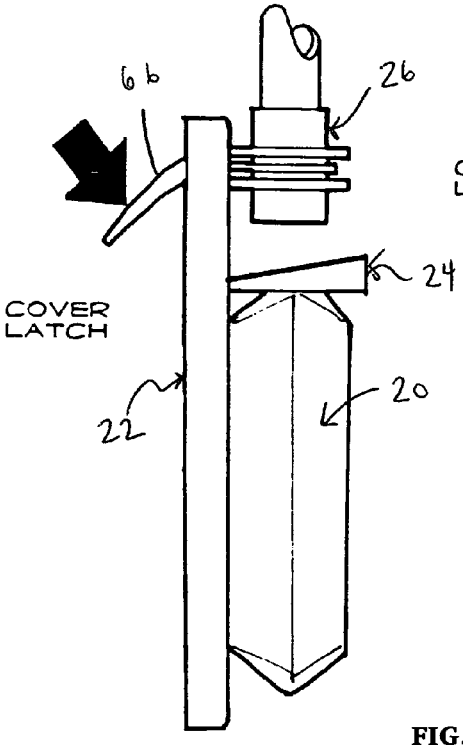
FIGS. 8 and 9 are profile views of a cover latch being pivoted downwards to engage a telescopic nozzle of the vacuum bag housing assembly of FIG. 1.
Figure 9:
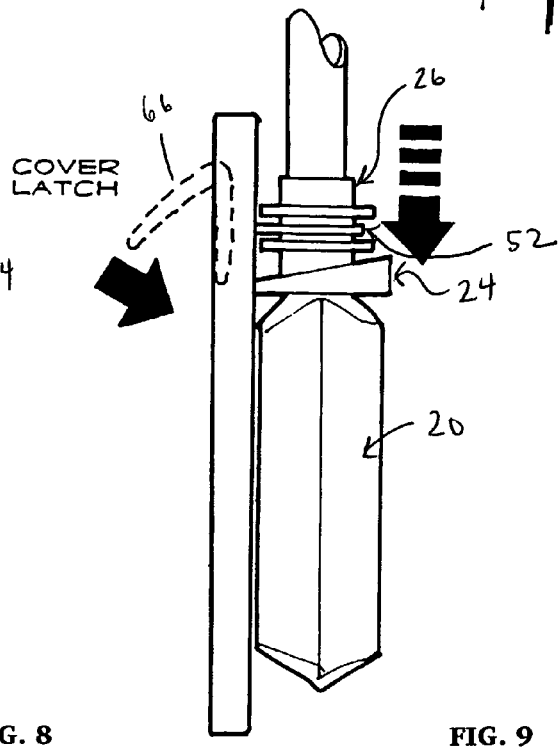

Once the vacuum bag collar 28 is disposed within the bag collar receiver 24, the housing cover 22 can be placed over the storage compartment 18. As shown in FIGS. 4 and 5, as the housing cover 22 is placed over the storage compartment 18, the U-shaped opening 58 in the nozzle fork 52 is slid around the telescopic nozzle end 26, so that the first nozzle fork prong 54 and the second nozzle fork prong 56 are disposed within the circumferential groove 48. The mounting assembly is preferably constructed such that when the telescopic nozzle end 26 is completely retracted, the nozzle fork 52 is vertically aligned with the circumferential groove 48. As shown in FIGS. 6-9, once the nozzle fork 52 is engaged with the telescopic nozzle end 26, the cover latch 66 can be pivoted downards, which in turn pulls the telescopic nozzle end 26 downwards and in engagement with the collar opening 30. In an exemplary embodiment of the invention, the cover latch 66 may also be used to activate a locking mechanism that locks the housing cover 22 in place over the storage compartment 18.

It should be appreciated that the mechanisms used to move the telescopic nozzle relative to the vacuum bag collar are not limited to those described herein. For example, in another embodiment of the invention, a sliding lever, rather than a pivoting lever, may be used to control the vertical position of the telescopic nozzle.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vacuum bag mounting assembly for housing a vacuum bag within a vacuum cleaner, the vacuum cleaner comprising a vacuum intake nozzle having an outlet end portion through which sucked in dirt is delivered to the vacuum bag mounting assembly, the vacuum bag mounting assembly comprising:

a vacuum bag storage compartment;

a vacuum bag collar receiver disposed within the vacuum bag storage compartment that engages a collar of the vacuum bag;

a telescopic nozzle end attached to the outlet end portion of the vacuum intake nozzle, the telescopic nozzle end being moveable along the outlet end portion towards and away from the collar of the vacuum bag; and a housing cover that covers the vacuum bag storage compartment, the housing cover comprising a nozzle engagement member that engages the telescopic nozzle, the nozzle engagement member being moveable between a first position in which the telescopic nozzle end is engaged with the vacuum bag collar and a second position in which the telescopic nozzle end is disengaged with the vacuum bag collar.

2. The vacuum bag mounting assembly of claim 1, wherein the housing cover further comprises a lever operatively attached to the nozzle engagement member for moving the nozzle engagement member between the first and second positions.

3. The vacuum bag mounting assembly of claim 2, wherein the nozzle engagement member is biased in the second position.

4. The vacuum bag mounting assembly of claim 3, wherein the nozzle engagement member is biased in the second position by a spring.

5. The vacuum bag mounting assembly of claim 4, wherein the housing cover further comprises a pulley, and the lever is operatively attached to the nozzle engagement member by a cable that extends around the pulley such that lowering of the lever places the nozzle engagement member in the first position and raising of the lever places the nozzle engagement member in the second position.

6. The vacuum bag mounting assembly of claim 1, wherein the vacuum bag collar receiver comprises a U-shaped opening for engagement with the vacuum bag collar.

7. The vacuum bag mounting assembly of claim 1, wherein the telescopic nozzle end comprises a circumferential groove.

8. The vacuum bag mounting assembly of claim 1, wherein the nozzle engagement member comprises a U-shaped opening for engagement with the circumferential groove of the telescopic nozzle end.

9. A vacuum cleaner comprising the vacuum bag mounting assembly of claim 1.

10. A vacuum cleaner comprising:

a base portion;

a vacuum nozzle head disposed at a bottom portion of the base portion;

a handle for maneuvering the vacuum cleaner;

a vacuum bag mounting assembly for housing a vacuum bag; and a vacuum intake nozzle having an outlet end portion through which sucked in dirt is delivered to the vacuum bag housing assembly, wherein the vacuum bag mounting assembly comprises:

a vacuum bag storage compartment;

a vacuum bag collar receiver disposed within the vacuum bag storage compartment that engages a collar of the vacuum bag;

a telescopic nozzle end attached to the outlet end portion of the vacuum intake nozzle, the telescopic nozzle end being moveable along the outlet end portion towards and away from the collar of the vacuum bag; and a housing cover that covers the vacuum bag storage compartment, the housing cover comprising a nozzle engagement member that engages the telescopic nozzle, the nozzle engagement member being moveable between a first position in which the telescopic nozzle end is engaged with the vacuum bag collar and a second position in which the telescopic nozzle end is disengaged with the vacuum bag collar.

11. The vacuum cleaner of claim 10, wherein the housing cover further comprises a lever operatively attached to the nozzle engagement member for moving the nozzle engagement member between the first and second positions.

12. The vacuum cleaner of claim 11, wherein the nozzle engagement member is biased in the second position.

13. The vacuum cleaner of claim 12, wherein the nozzle engagement member is biased in the second position by a spring.

14. The vacuum cleaner of claim 13, wherein the housing cover further comprises a pulley, and the lever is operatively attached to the nozzle engagement member by a cable that extends around the pulley such that lowering of the lever places the nozzle engagement member in the first position and raising of the lever places the nozzle engagement member in the second position.

15. The vacuum cleaner of claim 10, wherein the vacuum bag collar receiver comprises a U-shaped opening for engagement with the vacuum bag collar.

16. The vacuum cleaner of claim 15, wherein the telescopic nozzle end comprises a circumferential groove.

17. The vacuum cleaner of claim 10, wherein the nozzle engagement member comprises a U-shaped opening for engagement with the circumferential groove of the telescopic nozzle end.

* * * * *